United States Patent [19]

Hood

[11] 4,298,440

[45] Nov. 3, 1981

[54] METHOD AND APPARATUS FOR THE CORONA DISCHARGE TREATMENT OF WEBS, AND WEBS TREATED THEREWITH

[75] Inventor: John L. L. Hood, Taunton, England

[73] Assignee: British Cellophane Limited, Bridgwater, England

[21] Appl. No.: 115,395

[22] Filed: Jan. 25, 1980

[30] Foreign Application Priority Data

Feb. 5, 1979 [GB] United Kingdom ..... 3885/79

[51] Int. Cl.[3] ..... H01T 19/00

[52] U.S. Cl. ..... 204/165; 204/168; 250/531; 422/186; 425/174.8 E

[58] Field of Search ..... 250/531; 422/186; 425/174.8 E; 204/165, 168

[56] References Cited

U.S. PATENT DOCUMENTS

| | | | |
|---|---|---|---|
| 3,291,711 | 12/1966 | Moyer | 250/531 |
| 3,397,136 | 8/1968 | Balogh . | |
| 3,409,537 | 11/1968 | Cannon . | |
| 3,600,122 | 8/1971 | Coleman | 8/115.7 |
| 4,024,038 | 5/1977 | Luc | 204/168 |
| 4,057,723 | 11/1977 | Sarid et al. . | |
| 4,145,386 | 3/1979 | Rosenthal | 264/22 |

FOREIGN PATENT DOCUMENTS

| | | |
|---|---|---|
| 789 | 2/1979 | European Pat. Off. . |
| 765545 | 1/1957 | United Kingdom . |
| 771234 | 3/1957 | United Kingdom . |
| 1228987 | 4/1971 | United Kingdom . |
| 1373235 | 11/1974 | United Kingdom . |
| 1448385 | 9/1976 | United Kingdom . |

OTHER PUBLICATIONS

*Handbook of Chemistry & Physics,* 53rd Ed., (1973), The Chemical Rubber Co., Cleveland Ohio, pp. E-46 & E-48.

*Primary Examiner*—Deborah L. Kyle

*Attorney, Agent, or Firm*—Watson, Cole, Grindle & Watson

[57] ABSTRACT

Apparatus for the corona discharge treatment of a travelling web such as a plastics or cellulose film comprises a pair of spaced conductors with an associated alternating voltage power supply set at such a distance apart that the possibility of spark or arc discharge is avoided, at least one conductor having mounted thereto an electrode member extending towards the other conductor to define a gap across which a corona discharge can be formed. The electrode member consists of a dielectric material having a dielectric constant of at least 8, preferably at least 80, and may consist of a plate with an edge directed towards the other conductor. Preferably the plate is formed of one or more ceramic tiles based upon a titanium and/or zirconium compound. In another form the electrode member consists of a row of rods or two or more rows of spaced rods in staggered relationship.

16 Claims, 5 Drawing Figures

METHOD AND APPARATUS FOR THE CORONA DISCHARGE TREATMENT OF WEBS, AND WEBS TREATED THEREWITH

This invention is concerned with corona discharge apparatus for the treatment of travelling web materials.

It is well known to treat the surfaces of plastics films, cellulose films and other web materials with a silent or glow electric discharge, hereinafter referred to as a "corona discharge", to modify the surface properties of the surfaces so as to render the surfaces receptive to printing inks, bonding agents, etc.

In such processes, the web materials are passed between a pair of electrodes which are connected to a high voltage alternating electrical power supply and are subjected to the action of a corona discharge formed between the electrodes as a result of ionisation of the air or other gas in the gap between the electrodes. In order to avoid the corona discharge developing into a destructive continuous spark or arc discharge, hereinafter referred to as "arc discharge", a dielectric material is interposed between the electrodes to limit the current flow across the gap.

In a corona discharge treatment apparatus as described in British Patent Specification No. 715914, one electrode takes the form of a plate while the other electrode is an earthed drum for carrying a plastic film through a corona discharge formed between the plate and the drum. The plate is covered with a dielectric material on the side facing the drum to prevent an arc discharge between the electrodes. Such dielectric materials are constantly exposed to the corona discharge and gradually deteriorate, particularly at high spots of discharge, until eventually there is a failure and an arc discharge occurs between the plate and the drum.

In another form of corona discharge treatment apparatus of similar construction, the dielectric material is applied to the drum surface instead of to the plate electrode. By these means the corona discharge is not fixed upon one spot of the dielectric material but is, in fact, uniformly distributed over the entire surface owing to the rotation of the drum and thus, the rate of deterioration of the dielectric material is slowed down. Nevertheless, deterioration of the dielectric material eventually leads to total breakdown accompanied by an arc discharge which causes failure and loss in production as well as possible damage to the apparatus. This is only avoided by a constant watch and replacement of dielectric material showing signs of deterioration.

The present invention seeks to avoid such problems by providing that electrical conductors in the apparatus are sufficiently far apart to preclude an arc discharge between them even when the only intervening material is a gas, for example air, and by routing alternating electrical current to the gap, wherein the corona discharge is formed, by means of a dielectric material.

According to the present invention apparatus for the corona discharge treatment of a travelling web comprises a pair of spaced electrical conductors and a power source for supplying an alternating electrical voltage across the conductors, at least one conductor having an electrode member mounted thereto in electrical contact, the electrode member being formed from a dielectric material having a dielectric constant of at least 8 and extending towards the other conductor to define between the electrode member and the other conductor, or another electrode member extending from the other conductor, a gap in which a corona discharge can form and through which the travelling web can be drawn the conductors being sufficiently spaced apart to preclude an arc discharge between the conductors. The minimum distance apart of the electrical conductors required to preclude an arc discharge depends, of course, upon the voltage applied across the conductors. For example, when the applied voltage is 6 Kilovolts the conductors should not be spaced apart by less than about 20 Millimeters. When the applied voltage is 12 Kilovolts the spacing of the conductors should not be less than about 40 Millimeters and when the applied voltage is 20 Kilovolts the spacing of the conductors should not be less than about 80 Millimeters. For practical purposes, we have found that the conductors should preferably be spaced apart by at least 35 Millimeters.

The travelling web may be drawn through the gap by suitable drawing means which keep the web out of contact with the electrode member and the other conductor or other electrode member. However, in a preferred form of the invention, one conductor only has an electrode member mounted thereto and the other conductor is a flat plate guide which serves to guide the web through the corona discharge formed in the gap between the electrode member and the plate guide or, more preferably, a rotatable drum which serves to carry the web to be treated through the corona discharge formed in the gap between the electrode member and the rotatable drum.

The electrode member may take the form of a plate in which an edge is directed towards the other conductor or may take the form of a series of abutting plates e.g. ceramic tiles. Alternatively, the electrode member may take the form of a series of abutting rods having circular, square, rectangular, hexagonal or other convenient cross section or more preferably two or more staggered rows of spaced rods, the spacing between the rods preferably being less than the diameter of a single rod, to ensure a substantially uniform density of corona discharge in the gap.

The dielectric material from which the electrode member is formed preferably has a dielectric constant of at least 80 and more preferably, about 170. There is no specific upper limit but for practical purposes the dielectric constant should not exceed about 750. The dielectric constant of some materials will vary significantly with temperature and applied a/c frequency. For such materials, the above figures should be taken as referring to a temperature of 20° C., and an applied frequency of 20 Kilocycles.

The material of the electrode member should be one which does not readily degrade under electrical stress, and may conveniently be a ceramic based on a titanium and/or a zirconium compound, for example, titanium dioxide, barium titanate, barium aluminium titanate, barium titanate zirconate or calcium titanate. The electrode member may readily be formed from such ceramic materials by pressing or by extrusion of the raw materials prior to firing.

The alternating voltage supplied by the power source is preferably from 6 to 20 Kilovolts at a frequency of from 2 to 50 Kilohertz, more preferably from 10 to 50 Kilohertz.

The invention also includes a process for the treatment of travelling web materials with a corona discharge comprising forming a corona discharge in a gap between an electrode member having a dielectric constant of at least 8 in electrical contact with an electrical conductor and a second electrical conductor or a second electrode member in electrical contact with a second conductor, the electrical conductors being supplied with an alternating electrical voltage and being sufficiently spaced apart to preclude an arc discharge between the conductors.

The invention will now, by way of example, be more specifically described with reference to the accompanying drawings in which.

Figure 1:
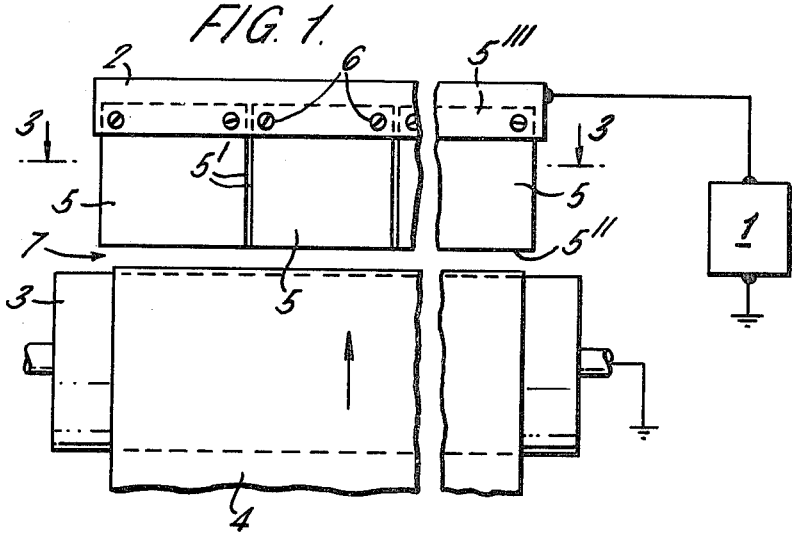
FIG. 1 is a partially schematic front elevation of apparatus according to an embodiment of the invention.
Figure 2:
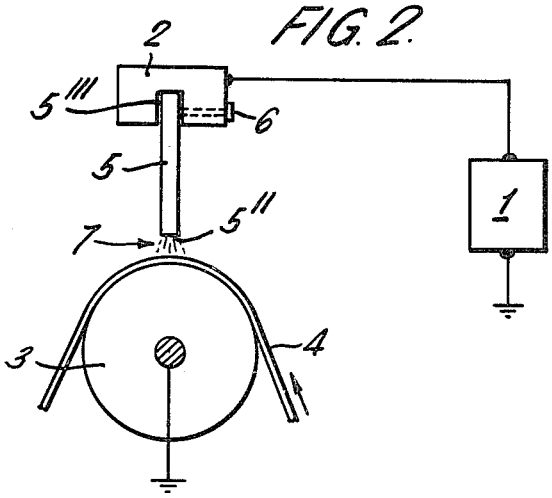
FIG. 2 is an end elevation of the apparatus of FIG. 1.
Figure 3:
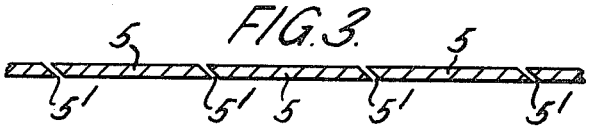
FIG. 3 is a section on line 3 . . . 3 of a part of FIG. 1.

In FIGS. 1 and 2, a power source 1, rated at 12 Kilovolt, supplies alternating electrical power at a frequency of 20 Kilohertz to a first conductor consisting of a metallic slotted rod 2. The return circuit for the power source 1 is via earth. A second conductor is an earthed rotatable metallic drum 3 which carries on its surface a web 4 of a material, for example a polyethylene film, to be surface treated by corona discharge. Fitted to the rod 2, as an electrode member, are a series of ceramic tiles 5, 100 millimeters square and 12 millimeters thick, which are principally based on titanium dioxide and have a dielectric constant of about 100. The tiles 5 are fixed by screws 6 and the abutting faces 5′ are set at an angle to provide a degree of overlap as shown in FIG. 3.

The rod 2 with the tiles 5 is brought up to the drum 3 until the bottom edges 5″ of the tiles 5 are separated from the drum surface by a gap 7 of about 2 millimeters. At this point an intense corona discharge occurs in the gap 7 due to current being routed from the rod 2 through the tiles 5 to the gap 7. However, since the rod 2 and the surface of the drum 5 are separated by about 80 millimeters there is no possibility at the voltage level employed for an arc discharge to occur between the rod 2 and the drum 3.

The series of ceramic tiles 5 may be glazed with a non-conductive glaze to facilitate cleaning except in the areas 5‴ where they are in contact with the rod 2, where a conductive glaze or local metallizing is preferred to facilitate conduction of the electrical current into each of the tiles 5.

Figure 4:
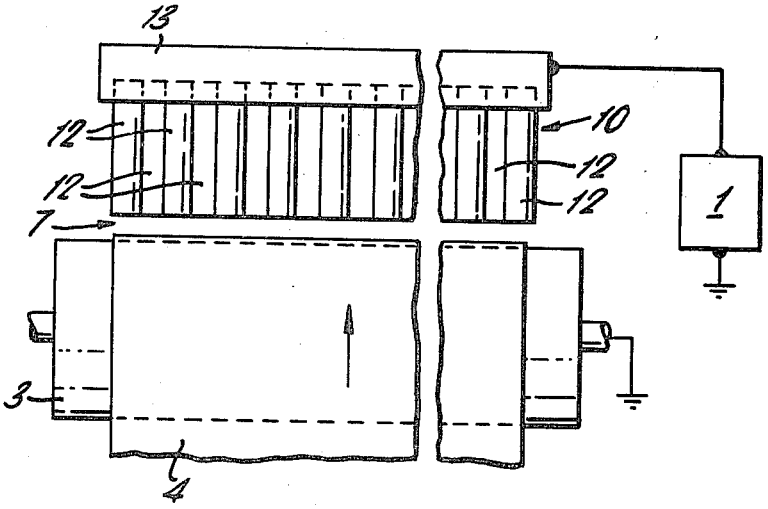
FIG. 4 is a partially schematic front elevation of apparatus according to a second embodiment of the invention.
Figure 5:
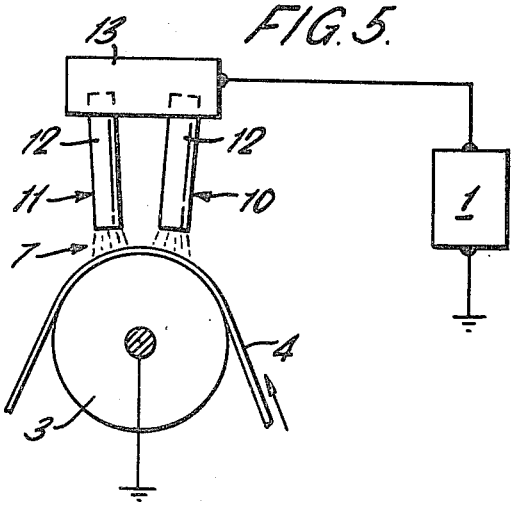
FIG. 5 is an end elevation of FIG. 4.

The apparatus shown in FIGS. 4 and 5 is similar to that shown in FIGS. 1 and 2 (like parts being numbered alike) except that the electrode member consists of two parallel rows 10, 11 of spaced cylindrical rods 12 of a ceramic based on calcium titanate having a dielectric constant of 175. One end of each of the rods is received in a corresponding hole in metallic conductor 13 in electrical contact therewith, the rods being secured with grub screws (not shown). The rods 12 are 13.5 millimeters in diameter, 85 millimeters long and protrude from the conductor 13 for a distance of 65 millimeters. The rods 12 are spaced 10 millimeters apart in the rows 10,11 and are so placed that in the direction of travel of the web 4, the rods 12 in row 11 are in line with the spaces between the rods 12 in row 10 so that there is a substantially uniform density of corona discharge in the treatment area. The rows 10 and 11 of rods 12 are spaced about 30 millimeters apart, and the gap 7 between the ends of the rods 12 and the drum 3 is 1.5 millimeters.

The spacing of the rods 12 permits easy ventilation of the gap 7 and the dissipation of any ionised pockets of air.

The rods 12 may be glazed to facilitate cleaning except for the ends in electrical contact with the conductor 13, which preferably are metallised.

The conductor 13 and the surface of the drum 3 are separated by a distance of 66.5 millimeters, at which distance there is no possibility of an arc discharge occurring between the conductor 13 and the drum 3.

Since the possibility of arc discharge is not present in apparatus according to the present invention the maintenance required is very much less than is required with corona discharge apparatus of the prior art. Deterioration of the ceramic dielectric material by corona discharge is very slow and in the event of a change being necessary through deterioration or mechanical damage, it is a simple, inexpensive, task to replace one or more of the tiles 5 or the rods 12.

A single ceramic strip may be employed in the place of the series of tiles 5 but in the event of damage, the entire strip must be replaced.

Further, it will be appreciated that where a series of tiles 5 is employed, the overlap of abutting tiles may be achieved by means other than setting the abutting faces at an angle, for example, by tongue and groove or half-halving type of joints.

In the two embodiments described above it can be seen that because of the spacing of the conductors it is not necessary for either conductor to be entirely covered with a dielectric material.

I claim:

1. Apparatus for the corona discharge treatment of a travelling web comprising means defining a gap wherein a corona discharge may be formed, and through which the travelling web may be drawn, a pair of spaced electrical conductors for supplying power for the discharge to the said gap defining means, and a power source for supplying an alternating electrical voltage across the conductors, the means defining the gap including an electrode member mounted in electrical contact to at least one of the conductors, the electrode member being formed from a dielectric material having a dielectric constant of from 80 to 750, and the conductors being sufficiently spaced apart to preclude an arc discharge therebetween.

2. Apparatus as claimed in claim 1 in which only one of the said conductors has an electrode member mounted thereto and the other conductor is a rotatable drum.

3. Apparatus as claimed in claim 1 in which the dielectric material is a ceramic material.

4. Apparatus as claimed in claim 3 wherein said ceramic material is formed of a transition metal compound.

5. Apparatus as claimed in claim 4 wherein said transition metal compound is selected from the group consisting of titanium compounds and zirconium compounds.

6. Apparatus as claimed in claim 5 wherein said transition metal compound is selected from the group consisting of titanium dioxide, barium titanate, barium aluminium titanate, barium titanate zirconate or calcium titanate.

7. Apparatus as claimed in claim 1 in which the electrode member comprises a plate having an edge directed towards the other conductor.

8. Apparatus as claimed in claim 7 in which the electrode member comprises a series of abutting tiles.

9. Apparatus as claimed in claim 7 in which the abutting faces of the tiles are set at an angle to provide a degree of overlap.

10. Apparatus as claimed in claim 1 in which the electrode member comprises a series of abutting rods.

11. Apparatus as claimed in claim 8 or claim 10 in which the electrode member is glazed with a nonconductive glaze except for the end in electrical contact with the supporting conductor.

12. Apparatus as claimed in claim 1 in which the electrode member comprises two or more staggered rows of spaced rods, the spacing of the rods being less than the diameter of a single rod.

13. Apparatus as claimed in claim 1 in which the power source is such as is capable of supplying a voltage of from 6 to 20 Kilovolts at a frequency of from 2 to 50 Kilohertz.

14. Apparatus as claimed in claim 1 wherein the conductors are spaced by at least 35 millimeters.

15. A process for the treatment of a travelling web material with a corona discharge comprising forming a corona discharge in a gap between an electrode member having a dielectric constant of from 80° to 75° in electrical contact with an electrical conductor, and a second electrical conductor, supplying the electrical conductors with an alternating electrical voltage, the two electrical conductors and being sufficiently spaced apart to preclude an arc discharge between them, and passing the web material through the gap.

16. A process as claimed in claim 15 in which the travelling web material is a plastics film.

* * * * *